United States Patent [19]

Rousseau et al.

[11] Patent Number: 4,991,328

[45] Date of Patent: Feb. 12, 1991

[54] STRUCTURES FORMED FROM JOINED ELEMENTS

[76] Inventors: Jean-Pierre Rousseau, 96 Rue de Miromesnil, Paris, France, 75008; Nicolai Canetti, 329 Douglas Rd., Chappaqua, N.Y. 10514

[21] Appl. No.: 344,875

[22] Filed: Apr. 28, 1989

[51] Int. Cl.[5] ..... G09F 1/12

[52] U.S. Cl. ..... 40/155; 40/156; 24/17 B

[58] Field of Search ..... 40/155, 152, 159.1, 40/152.1, 153, 156, 157; 24/17 B, 482

[56] References Cited

U.S. PATENT DOCUMENTS

| | | | |
|---|---|---|---|
| 916,208 | 3/1909 | Small | 24/18 |
| 1,052,906 | 2/1913 | Ellis | 24/18 |
| 3,676,944 | 7/1972 | Eubank, Jr. | 40/155 |
| 3,958,352 | 5/1976 | Eubank, Jr. | 40/155 |
| 4,028,832 | 6/1977 | Wu | 40/155 |
| 4,103,446 | 8/1978 | Maglott | 40/155 |
| 4,211,023 | 7/1980 | Eubank, Jr. | 40/155 |
| 4,736,538 | 4/1988 | Pierce et al. | 40/156 |

FOREIGN PATENT DOCUMENTS

| | | | |
|---|---|---|---|
| 5898 | of 1888 | United Kingdom | 24/17 B |

*Primary Examiner*—Kenneth J. Dorner
*Assistant Examiner*—Brian K. Green
*Attorney, Agent, or Firm*—Schweitzer Cornman & Gross

[57] ABSTRACT

Devices for the display of photographs and other items constructed from a plurality of generally flat, plate-like elements joined together by one or more elastic bands. The bands extend out beyond the outside surfaces of the assembled structures, and serve as bumpers for the unit, insulating the unit from contact with the surface upon which it is placed. In a preferred embodiment a solid structure of a plurality of similarly-sized plates is formed. In an alternative embodiment, the plates are connected to form a hollow structure.

3 Claims, 3 Drawing Sheets

STRUCTURES FORMED FROM JOINED ELEMENTS

BACKGROUND OF THE INVENTION

The present invention relates to a new and improved construction by which an object or structure may be formed from plate or panel-like members. The present invention is of great utility in the manufacture of picture frames, display cubes and other decorative items.

The present invention utilizes generally flat elements, advantageously rectangular, which may be assembled and aligned to form a desired composite structure. The individual structural elements are held together by one or more elastic bands which are supported and maintained in place about corners of the elements. The resiliency of the bands both maintains the structural elements in contact with each other in the desired configuration and protects the surfaces of the composite structure from contact with a surface upon which the structure is placed. In a preferred embodiment, the bands are maintained in place by grooves in exposed surfaces of the elements. The grooves are dimensioned such that the bands project beyond the planes defined by the surfaces of the elements and the formed composite structure, whereby the structure rests upon the bands, rather than the individual elements, when placed upon a surface.

BRIEF DESCRIPTION OF THE DRAWINGS

A fuller understanding of the present invention, and the features and advantages therefor, will be obtained upon consideration of the following description of preferred, but nonetheless illustrative embodiments of the invention, coupled with the annexed drawings, wherein.

DETAILED DESCRIPTION OF PREFERRED EMBODIMENTS

Figure 1:
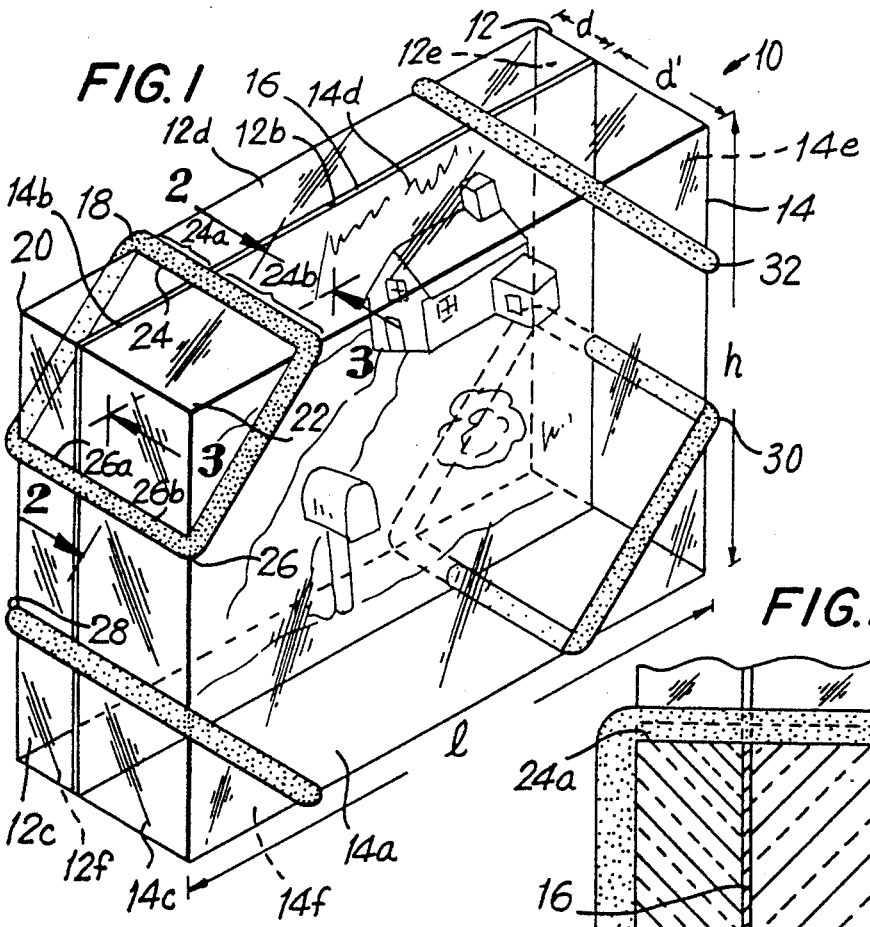
FIG. 1 is a perspective view of a representative structure of the present invention in the form of a picture frame or display unit.
Figure 2:
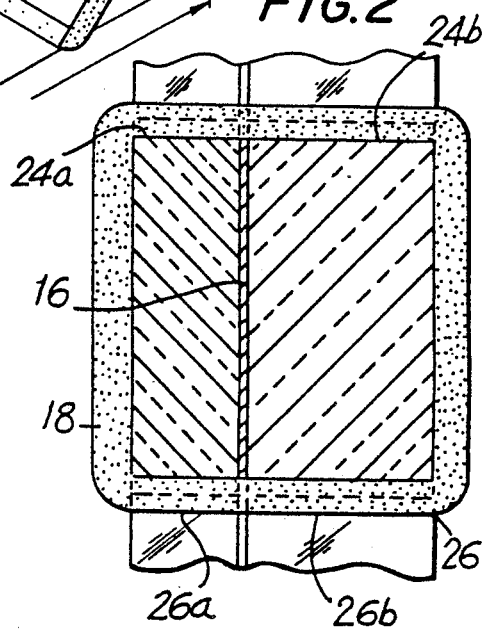
FIG. 2 is an oblique section view taken along the direction 2—2 of FIG. 1.

Referring to the Figures and initially to FIGS. 1 through 4 thereof, three-dimensional construction 10, which may serve as a novel form of a picture frame or display unit, is formed from a pair of plates 12 and 14, which may preferably be in the form of rectangular parallepiped elements which may advantageously have generally the same height h and length l, but are of different depths d and d'.

The specific choice of length, height and depth is variable, but for a picture display unit intended to rest on a desk or similar surface, for example, the total depth d+d' should be chosen to provide a stable base. For a height and length of 3 inches by 4 inches, for example, the total depth should be no less than about 1 inch.

Each of the plates 12 and 14 is provided with a pair of major faces 12*a*, *b* and 14*a*, *b*, respectively, bounded and joined by the edge faces 12*c*-*f*, respectively.

The plates are placed in a generally abutting position along their inwardly-directed faces 12*b*, 14*b* to produce the construction 10 having the height and width, and a depth equal to the total depth, of the two plates. A photograph, card or similar flat item 16 to be displayed is placed between the abutting faces, as the elements 12, 14 are normally fashioned of a clear material, such as acrylic plastic. Alternatively, a portion of the interiors of at least one of the plates 12, 14 may be hollowed out through its respective abutting face 12*b* or 14*b*, leaving peripheral abutting shoulders on the faces to allow an object to be placed within the resulting hollow center construction for display purposes. While two plates are depicted in the Figures, it is recognized that a plurality of plates can be combined to allow a variety of objects to be displayed in a "layered" effect. As used herein, the term "generally abutting" is meant to include actual contact between the inwardly-directed faces, as well as configurations where the inwardly-directed faces are separated by one or more intermediate layers, such as created by an embraced photograph and/or intermediate plates.

The plates are maintained in position by a series of tension elements which cross the interface between the plates and draw the plates together. In a preferred embodiment, such tension elements comprise portions of elastic bands which encircle the corners of the resulting construction 10. In particular, each of the bands surrounds a pair of adjacent corners of the individual plates, such as front and back corners 20, 22, respectively, which are located on opposite sides of the interface between the two plates 12, 14.

Figure 3:
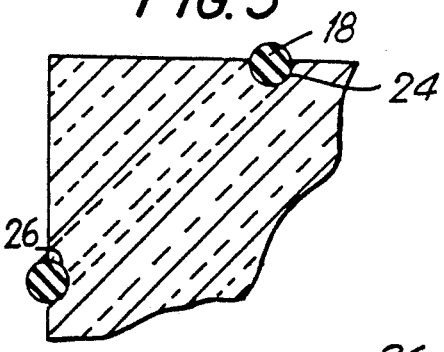
FIG. 3 is a partial sectional elevation view taken along the direction 3—3 of FIG. 1.
Figure 4:
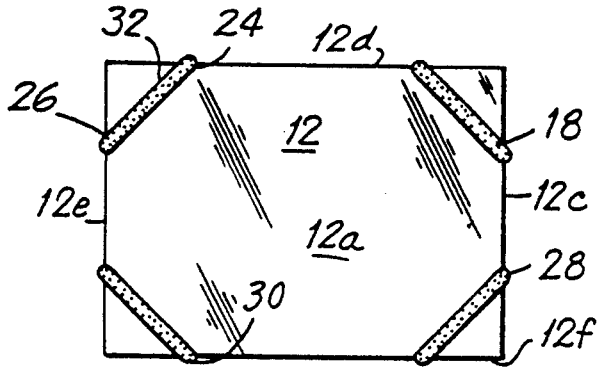
FIG. 4 is a rear elevation view of the structure of FIG.1.

To maintain the bands in position to place tension across the interface, a series of grooves or channels as best seen in FIG. 3, partially encircle the adjacent opposed corners of the elements 12, 14 and are located on the edge faces which form the corners. Thus, with respect to adjacent opposed corners 20 and 22, for example, a first groove 24 extends from outer face 12*a* of plate 12 to outer face 14*a* of plate 14, and is formed of a first segment 24*a* in the top edge face 12*d* of plate 12 and a second segment 24*b* in the top edge face 14*d* of element 14. Similarly, second groove 26 is formed with its first portion 26*a* in side edge face 12*c* of first plate 12 and a second portion 26*b* in side edge face 14*c* of plate 14. The groove segments are colinear to allow the band 18 to fit therein, and are dimensioned to be of a semi-circular cross-section, having a radius or depth approximately one-half the thickness of the band 18, such that the band projects above the construction 10's surface along its entire circuit. Thus, the band 18, as well as similar bands 28, 30 and 32 located in their respective grooves in the edge faces, each serve as a bumper or foot for the construction, supporting the construction on a surface irrespective of the orientation of the construction upon the surface, while retaining the elements 12 and 14 together in the desired configuration. Alternatively, in embodiments where it is intended that the structure have a preferred orientation with respect to a mounting surface, the bands may be utilized only with respect to the embodiment surfaces subject to contact, with other fastening means being utilized in conjunction with the bands at other locations.

While the grooves are shown in the Figures as extending completely across the edge faces, it is understood that it is not necessary for them to have such a length, so long as they are of a sufficient length to maintain the bands in place with respect to the interface. Alternatively, other means for positioning the bands may be used, such as tabs or projections, as long as the positioning means do not extend beyond the bands to defeat the intended bumper function.

Figure 8:
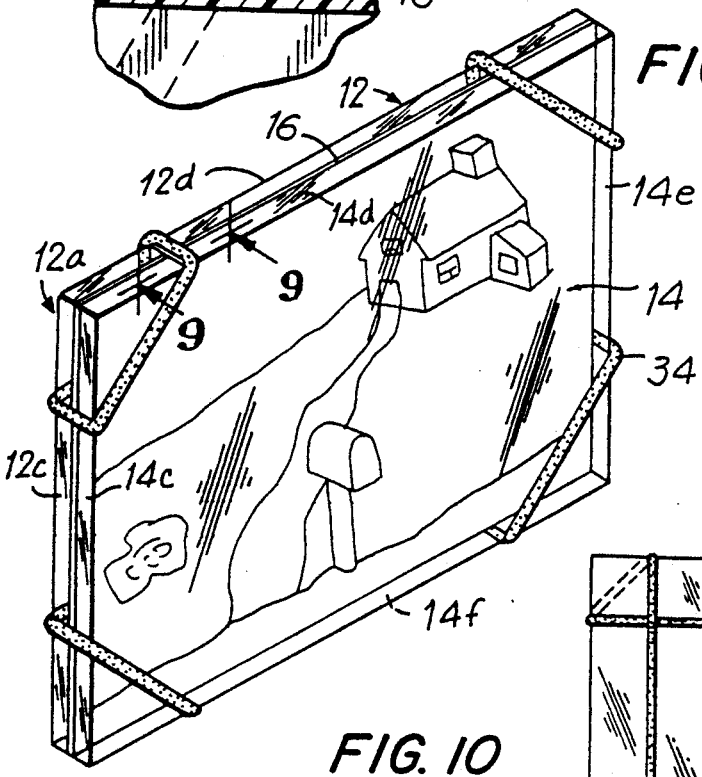
FIG. 8 is a perspective view of a third embodiment of the present invention utilizing a single elastic band.
Figure 9:
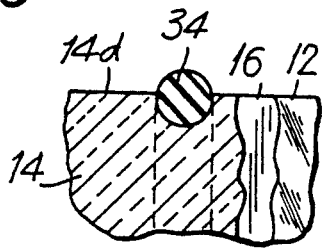
FIG. 9 is a partial elevation view in section taken along direction 9—9 of FIG. 8.
Figure 10:
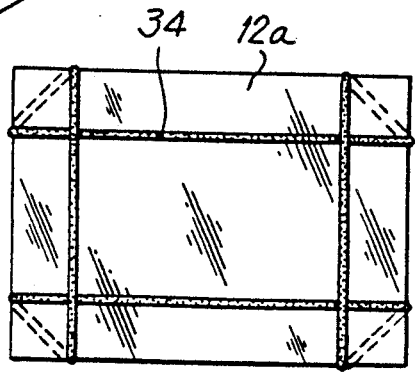
FIG. 10 is a rear elevation view of the embodiment of FIG. 8.

As depicted in FIGS. 8 through 10, the individual elastic bands may be replaced by a continuous band 34, which is directed around the construction so that it passes through each of the grooves surrounding each of the corners of the construction. As may be best seen in FIG. 10, the band 34 spans each of the distances between the groove pairs associated with a given corner across the front face 14*a*, rests within the grooves associated therewith, the band element then passing on the rear face 12*a*, as best seen in FIG. 10, to the opposed groove on the opposite edge of the construction. The loop material again spans the corner upon the front face of the construction, and passes through the next groove to the rear face, whereby it travels to the next opposite corner. This construction secures the individual elements 12 and 14 at each of the corners, but utilizes a single, rather than a multiple, band attachment.

Figure 12:
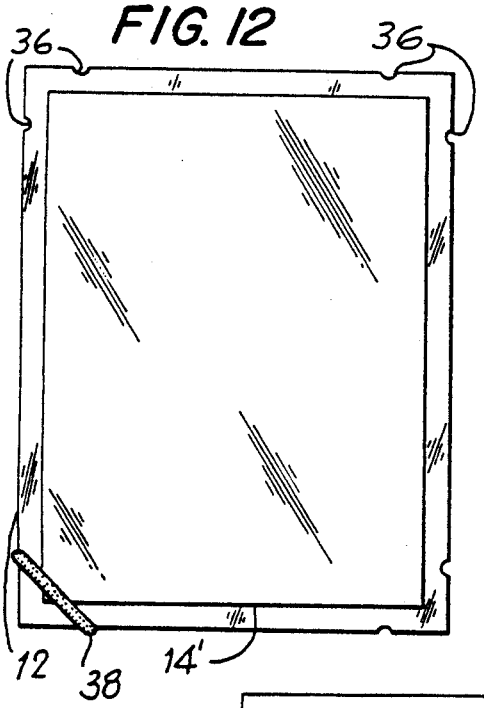
FIG. 12 is a front elevation view of an alternative embodiment of the invention in the format of FIG. 8 in which one of the structural elements is inset from the edges of another structural element.

As seen in FIG. 12, the plates 12, 14' need not be of the same height and width. In an alternative embodiment, the plate 14' is of a height and width smaller than that of plate 12 by a distance at least equal to twice the depth of the grooves 36, such that plate 14' may be centered on plate 12 with clearance established for the grooves in plate 12. The corners of plate 14', however, are still retained by the bands such as band 38. This embodiment has the advantage of decreased cost, as the plate 14' need not be machined with grooves on its edges. In fact, the plate 14' may be the displayed object itself such as a photograph, or may be a combination photograph and backing board or the like as to eliminate the need for a second plastic-like plate member, the photograph itself serving as a plate.

Figure 5:
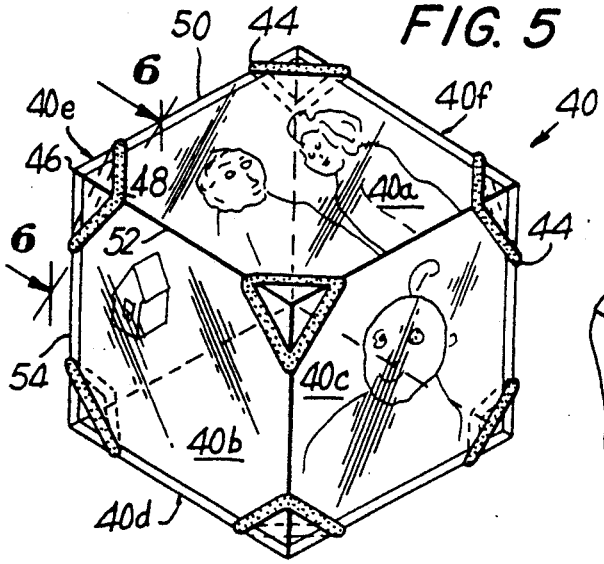
FIG. 5 is a perspective view of an alternative structure of the present invention in the form of a hollow display cube.
Figure 6:
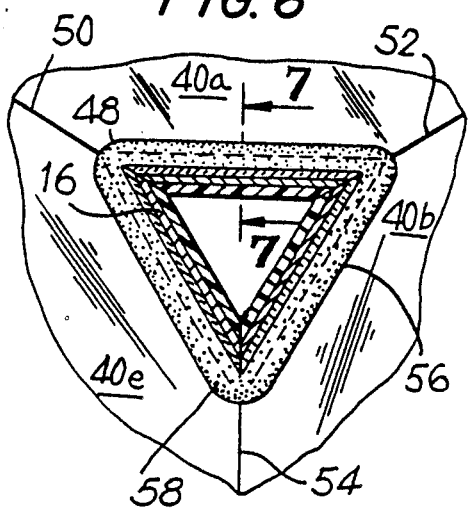
FIG. 6 is an oblique section view taken along direction 6—6 of FIG. 5.
Figure 7:
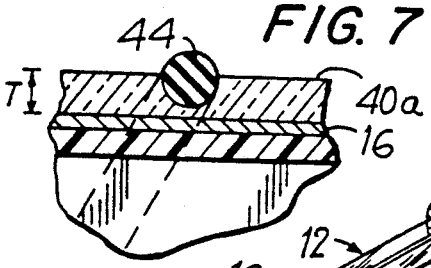
FIG. 7 is a partial section view taken along direction 7—7 of FIG. 6.

The construction depicted in FIGS. 5 through 7 illustrates the embodiment of the invention wherein the construction has its surfaces preferably formed from sheet elements, rather than elements which may have a substantial thickness, as previously described. Such a construction may be preferable for items in which it is desired to have a hollow center, and for items where the weight of a solid construction might be objectionable.

Accordingly, and as depicted in FIGS. 5 through 7, each of the faces 40*a–f* of construction 42 is formed of a piece of sheet material having a thickness T, as seen in FIG. 7, substantially less than its width and length. For a structure as shown in FIG. 5 whose height, width and length are several inches, clear acrylic plastic sheets, having a thickness of ⅛ inch, may be employed. Each of the faces 40*a–f* are sized to form the desired construction, and have their edges beveled to allow them to abut and be maintained in position by the elastic bands 44. For corner angles of 90 degrees, as in a cubic construction, a 45 degree bevel is preferred. As may be appreciated, each of the corners of the resulting cubic structure 42 is thus created and bounded by the intersection of three mutually perpendicular faces along three mutually perpendicular edges which converge at the corner.

Each of the faces surrounding a corner has a groove milled in its outwardly-directed surface adjacent the corner between its edges. Thus, with respect to corner 46 as seen in FIG. 6, groove 48 is located on the surface of face 40*a*, and connects edges 50 and 52. Similarly, groove 56 on the surface of face 40*b* connects the edges 52 and 54, while groove 58 on the surface of face 40*e* connects edges 54 and 50. Each of the grooves is similarly positioned on its respective face such that the adjacent groove elements, such as 48, 56 and 58, form a continuous track, encircling the corner for the receipt of a band 44. As in the prior constructions, the depth of the grooves 60 is approximately one-half the thickness of the band, so that an installed band remains proud of the construction surface along its entire length.

The constriction of the band about the corner pulls each of the adjacent face elements into the corner, thus resulting in a highly rigid construction which is lightweight due to the use of sheet-like materials for its construction, yet easy to assemble and disassemble, and is provided with integral bumper means which entirely encircle and insulate the resulting structure from contact with the surface upon which it is place.

Figure 11:
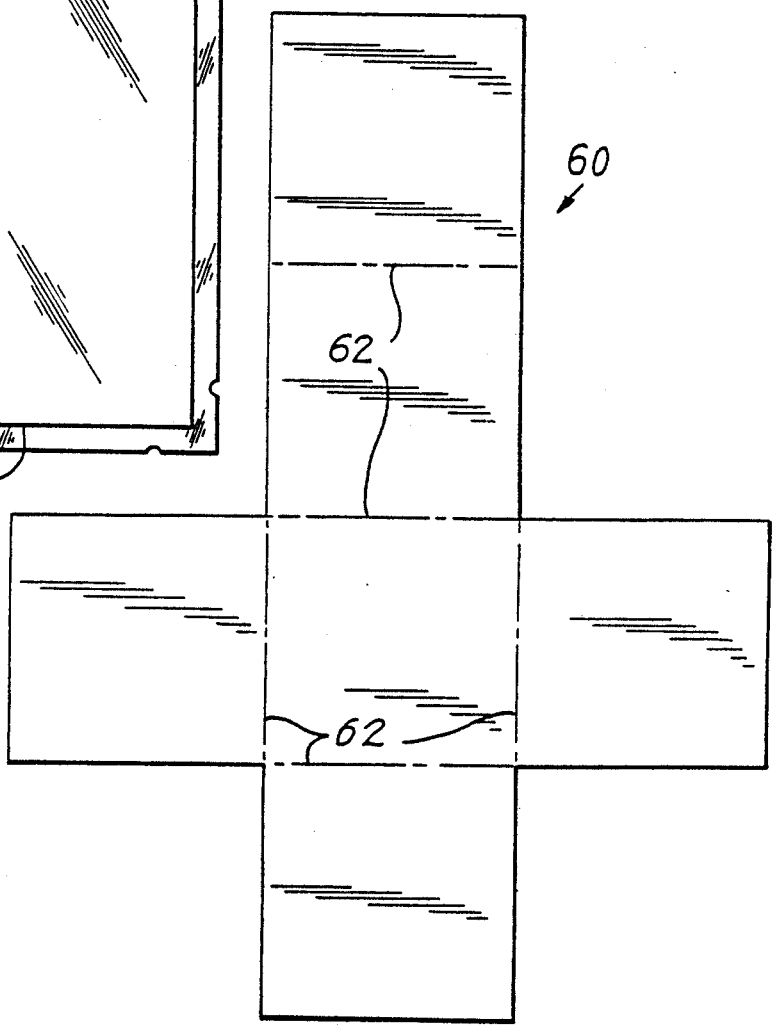
FIG. 11 is a plan view of a sheet-like element which may be soldered and assembled within the construction of FIGS. 5-7 to support items therein.

Photographs, stamps or the like may be affixed, using glue, tape or other known means, to the inside surfaces of the faces of construction 42, either alone or in combination with an appropriate sheet-like backing material. Alternatively, the backing material itself may be formed into a three-dimensional insert which closely fits within the volume defined by the construction's sides, the pictures or other items of interest being located between the inner surfaces of the faces and the insert. As illustrated in FIG. 11, such an insert 60 for the cube depicted in FIG. 5 may be advantageously formed of cardboard or similar material having a cruciform shape, with integral fold or score-lines 62 allowing a box-like construction to be created and inserted within the cube to support the displayed items therein.

I claim:

1. A display structure, comprising first and second plates, each of said plates having front and rear faces bounded by a plurality of side edges forming corners therebetween about peripheries of said plates, at least one of said faces on each of said plates being planar and adapted to be placed in a generally-abutting relation with the planar face of said other plate with the side edges of said plates being generally aligned; combination elastomeric bumper and tension means in the form of loops located at said corners embracing and surrounding the aligned portions of each of said plates about said corners, said loops maintaining said plates in compressive alignment and projecting outside and beyond the plate surfaces about the entirety of their lengths; and means located on the edges of at least one of said plates to retain said loops in the aligned portions-embracing and surrounding positions, said means comprising grooves in the aligned edges of at least one of said plates to accommodate a portion of said loops, said grooves having a depth less than a diameter of said loops when said loops are maintaining said plates in said compressive alignment.

2. The structure of claim 1, wherein said second plate is of a slightly lesser size than said first plate, said groove extending across the edges of said first plate.

3. The structure of claim 2, wherein said second plate is sized to avoid an overlay of the edges thereof with said grooves in said first plate.

* * * * *